US007044110B2

(12) United States Patent
Geyer

(10) Patent No.: US 7,044,110 B2
(45) Date of Patent: May 16, 2006

(54) FUEL INJECTION DEVICE FOR A COMBUSTION ENGINE

(75) Inventor: Gerhard Geyer, Stuttgart (DE)

(73) Assignee: Robert Bosch GmbH, Stuttgart (DE)

( * ) Notice: Subject to any disclaimer, the term of this patent is extended or adjusted under 35 U.S.C. 154(b) by 33 days.

(21) Appl. No.: 10/474,322

(22) PCT Filed: Dec. 5, 2002

(86) PCT No.: PCT/DE02/04456

§ 371 (c)(1),
(2), (4) Date: Oct. 8, 2003

(87) PCT Pub. No.: WO03/067072

PCT Pub. Date: Aug. 14, 2003

(65) Prior Publication Data

US 2004/0103883 A1 Jun. 3, 2004

(30) Foreign Application Priority Data

Feb. 8, 2002 (DE) ..... 102 05 186

(51) Int. Cl.
*F02M 37/04* (2006.01)

(52) U.S. Cl. ..... 123/514; 123/456

(58) Field of Classification Search ..... 123/446, 123/514, 456, 447, 467, 198 D
See application file for complete search history.

(56) References Cited

U.S. PATENT DOCUMENTS

| | | | | |
|---|---|---|---|---|
| 4,187,813 | A * | 2/1980 | Stumpp | 123/510 |
| 4,411,239 | A * | 10/1983 | Kelch | 123/557 |
| 5,795,995 | A * | 8/1998 | Shimaoka et al. | 73/40 |
| 6,142,127 | A * | 11/2000 | Maass | 123/514 |
| 6,234,151 | B1 * | 5/2001 | Eck | 123/514 |
| 6,715,469 | B1 * | 4/2004 | Ishimoto | 123/446 |
| 6,792,915 | B1 * | 9/2004 | Rembold et al. | 123/446 |

FOREIGN PATENT DOCUMENTS

| | | | |
|---|---|---|---|
| RU | 2037068 | C1 * | 6/1995 |
| SU | 1714183 | A1 * | 2/1992 |

* cited by examiner

*Primary Examiner*—Mahmoud Gimie
(74) *Attorney, Agent, or Firm*—Ronald E. Greigg

(57) ABSTRACT

The fuel injection device has a fuel-supply pump that delivers fuel from a fuel tank to a high-pressure pump which delivers fuel to a reservoir connected to at least one injector that injects fuel into the internal combustion engine. A fuel filter is disposed between the fuel-supply pump and the high-pressure pump, wherein a return for fuel from the at least one injector and/or from the reservoir to a low-pressure region is provided. The return is provided with an additional fuel filter and downstream of the fuel filter, the return feeds into the connection between the fuel-supply pump and the high-pressure pump.

10 Claims, 2 Drawing Sheets

FUEL INJECTION DEVICE FOR A COMBUSTION ENGINE

CROSS-REFERENCE TO RELATED APPLICATIONS

This application is a 35 USC 371 application of PCT/DE 02/04456 filed on Dec. 05, 2002.

BACKGROUND OF THE INVENTION

1. Field of the Invention

The invention is directed to an improved fuel injection device for an internal combustion engine.

2. Description of the Prior Art

A fuel injection device of the type with which this invention is concerned is known from the literature, for example *Dieselmotor-Management*, Verlag Vieweg, $2^{nd}$ edition 1998, p. 262. This fuel injection device has a fuel-supply pump that delivers fuel from a fuel tank to a high-pressure pump. The high-pressure pump delivers fuel into a reservoir, which is connected to injectors that inject fuel into the internal combustion engine. A fuel filter is disposed between the fuel-supply pump and the high-pressure pump. A return is provided for uninjected fuel, leading from the injectors to a low-pressure region that is constituted by the fuel tank. The disadvantage here is that the fuel-supply pump must continuously aspirate a large quantity of fuel, part of which must be returned to the fuel tank. The fuel-supply pump and the fuel filter must therefore be dimensioned as correspondingly large and short maintenance intervals for changing the fuel filter are required in order to assure that it functions reliably.

SUMMARY AND ADVANTAGES OF THE INVENTION

The fuel injection device according to the invention has the advantage over the prior art that the return of the uninjected fuel into the connection between the fuel-supply pump and the high-pressure pump requires a smaller quantity of fuel to be delivered by the fuel-supply pump so that this pump can be dimensioned as correspondingly smaller. The fuel filter can also be dimensioned as correspondingly smaller and the maintenance intervals for changing it can be extended. An additional fuel filter in the return assures that the returned fuel and the fuel conveyed back to the high-pressure pump are also sufficiently cleaned. The additional fuel filter here can, in terms of dimensioning and the maintenance intervals required for changing it, be designed independently of the other fuel filter in accordance with the reduced requirements since the returning fuel does not contain as many impurities as the fuel drawn from the fuel tank. The volume of the additional fuel filter here can also produce a damping of pressure oscillations and/or pressure surges in the return.

Advantageous embodiments and modifications of the fuel injection device according to the invention are disclosed. One embodiment assures that the fuel-supply pump does not deliver any fuel into the return. The opening pressure of the check valve can also be used to set the pressure level in the return.

BRIEF DESCRIPTION OF THE DRAWINGS

An exemplary embodiment of the invention is described herein below, in conjunction with the drawings, in which.

DESCRIPTION OF THE PREFERRED EMBODIMENT

Figure 1:
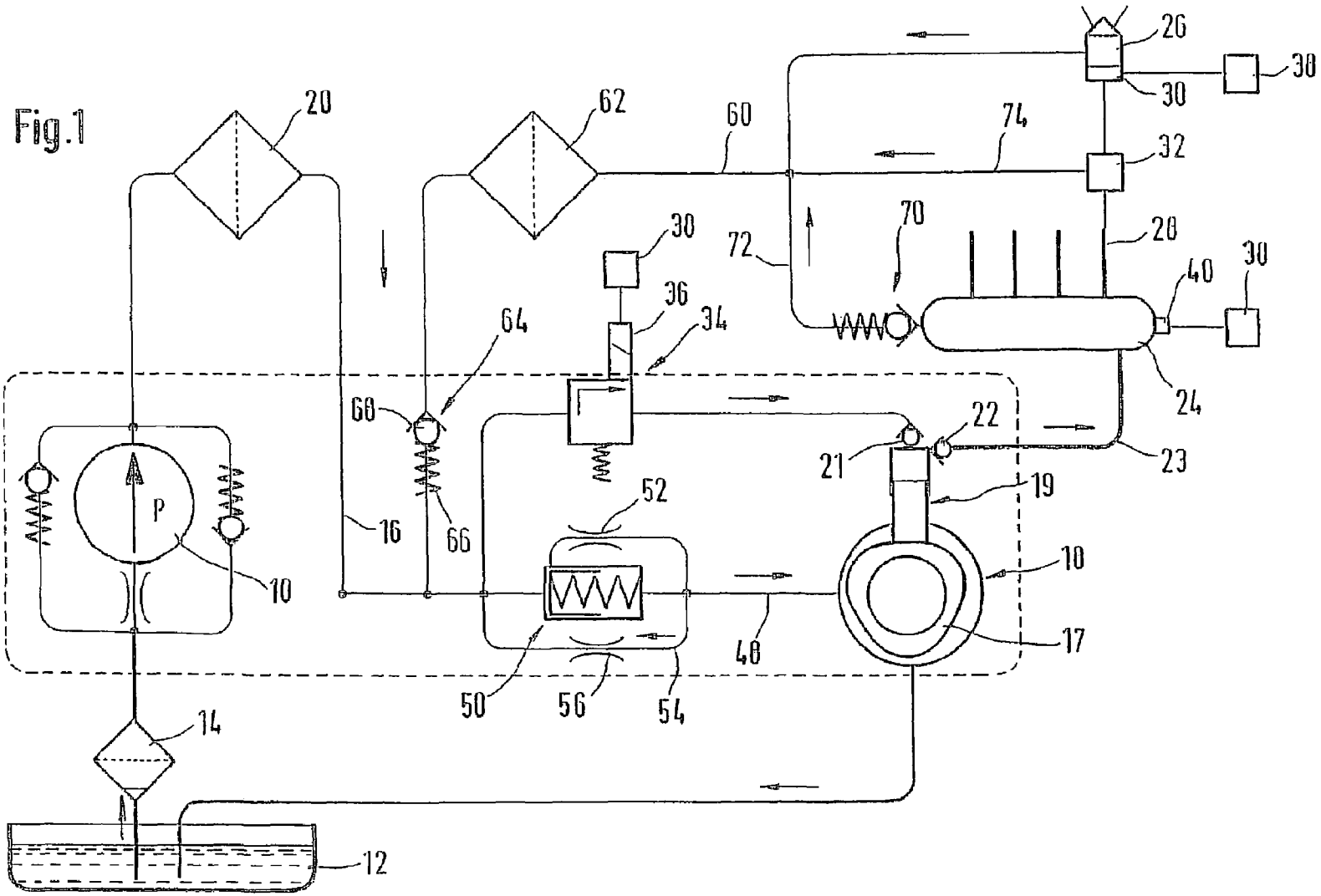
FIG. 1 schematically depicts a fuel injection device for an internal combustion engine and FIG. 2 shows a detail of the fuel injection device according to a modified embodiment.

FIG. 1 shows a fuel injection device for an internal combustion engine, for example of a motor vehicle. The internal combustion engine is preferably an autoignition internal combustion engine and has one or more cylinders. The fuel injection device has a fuel-supply pump 10 that can be disposed inside or outside a fuel tank 12 of the motor vehicle. The fuel-supply pump 10 can have an electric drive motor and draws fuel from the fuel tank 12, for example via a prefilter 14. The fuel-supply pump 10 can also be driven, for example, mechanically by the internal combustion engine or by a high-pressure pump 18 that will be explained below. From the outlet of the fuel-supply pump 10, a connection 16 leads to the high-pressure pump 18. Between the fuel-supply pump 10 and the high-pressure pump 18, the connection 16 is provided with a fuel filter 20 embodied as a fine filter through which the fuel delivered by the fuel-supply pump 10 flows. The fuel filter 20 is designed and dimensioned in such a way that the fuel quantity delivered by the fuel-supply pump 10 can pass through it. A maintenance interval for changing the fuel filter 20 is established so as to assure the function of the fuel filter 20.

For example, the high-pressure pump 18 has a number of pump elements 19, each of which has a piston that is guided in a cylinder bore and is set into a stroke motion by a drive unit 17. The drive unit 17 can, for example, have a camshaft on which the pump pistons of the pump elements travel, or an eccentric shaft and a polygon that is moved by it, which supports the pump pistons. The high-pressure pump 18 is preferably driven mechanically by the internal combustion engine. The fuel delivered by the high-pressure pump 18 is conveyed to a reservoir 24 via a connection 23. Each pump element 19 of the high-pressure pump 18 has an inlet valve 21 that opens into the pump element 19 and through which fuel can travel from the fuel-supply pump 10 into the pump element 19. Each pump element 19 also has an outlet valve 22 through which fuel can be displaced out of the pump element 19 and into the reservoir 24. An injector 26 is provided for each cylinder of the internal combustion engine and injects fuel into the combustion chamber of the cylinder. Each injector 26 is connected to the reservoir 24 via a connection 28 and an electrically triggered valve 30 controls the opening of the injector 26 for the fuel injection.

The connection 28 between the reservoir 24 and the injector 26 can contain a pressure booster device that further increases the pressure of the fuel supplied to the injector 26 in comparison to the pressure prevailing in the reservoir 24.

In the connection 16 of the fuel-supply pump 10 to the high-pressure pump 18, a fuel metering device 34 is provided, which adjusts the flow of fuel to the high-pressure pump 18. The metering device 34 has an electrically actuated control valve that is switched by an actuator 36, for example in the form of an electromagnet or a piezoelectric actuator. The actuator 36 is triggered by an electronic control unit 38. The reservoir 24 is provided with a pressure sensor 40 that is connected to the control unit 38. The control unit 38 triggers the actuator 36 in such a way that the fuel metering device 34 adjusts a flow of fuel to the high-pressure pump 18 that is required in order to maintain a preset pressure in the reservoir 24 by means of the fuel delivered by the high-pressure pump 18.

From the connection 16 of the fuel-supply pump 10 to the high-pressure pump 18, upstream of the fuel metering device 34, a connection 48 can be provided that leads to the drive unit 17 of the high-pressure pump 18, through which a part of the fuel delivered by the fuel-supply pump 10 can be supplied to the drive unit 17 to lubricate it. The connection 48 preferably contains a pressure valve 50 that opens toward the drive unit 17 and unblocks the connection 48 only when a preset pressure is exceeded. The pressure valve 50 assures that particularly during starting of the internal combustion engine, if a higher pressure in the reservoir 24 is required and this reservoir must be filled first, then the entire quantity of fuel delivered by the fuel-supply pump 10 is supplied to the high-pressure pump 18 and no fuel is diverted for lubricating the drive unit 17. Preferably a throttle restriction 52 is provided downstream of the pressure valve 50 and limits the flow in the connection 48. Downstream of the pressure valve 50 and the throttle restriction 52, a return line 54 can branch off from the connection 48 and feed into the connection 16 upstream of the pressure valve 50 and can contain a throttle restriction 56. Alternatively, the return line 54 can also feed into the fuel tank 12.

Figure 2:
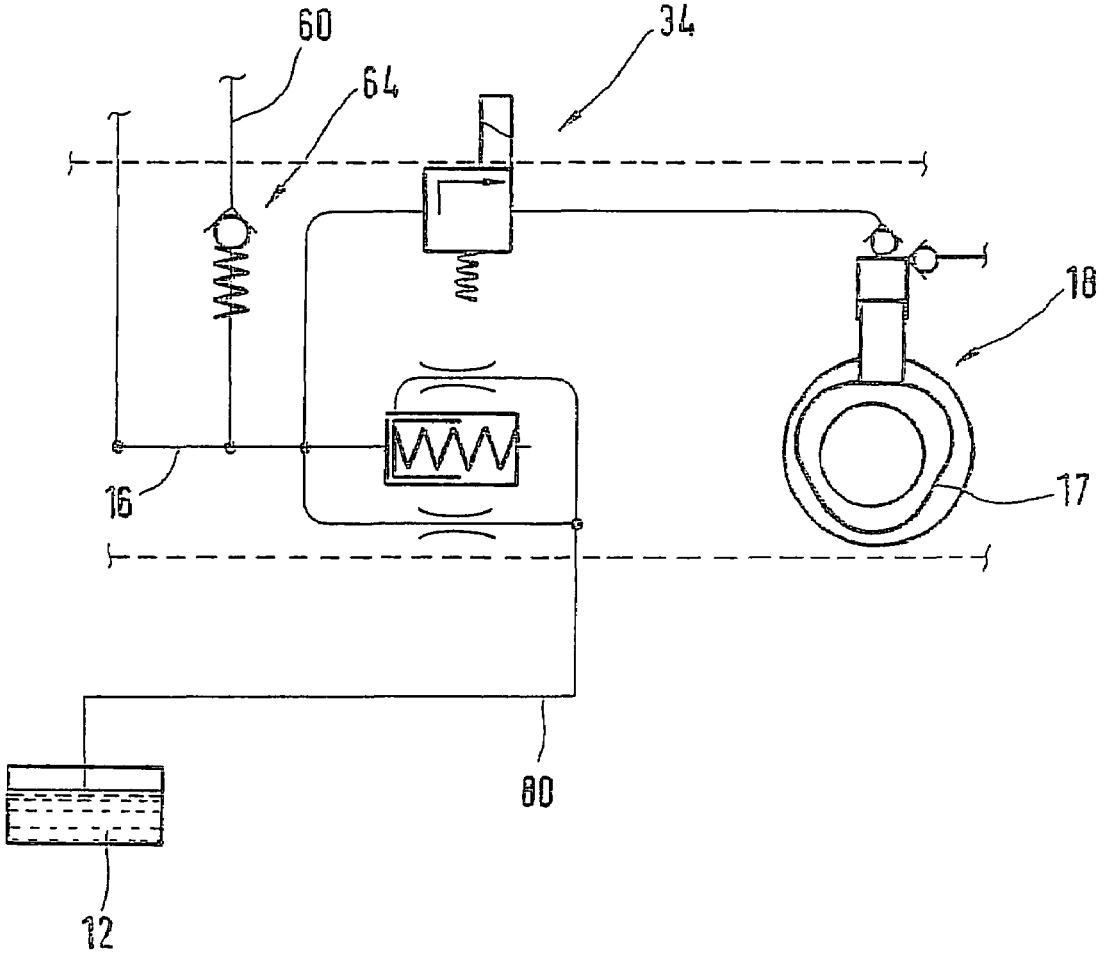

FIG. 2 shows a different embodiment of the fuel injection device in which the connection 48 does not lead to the drive unit 17 region of the high-pressure pump 18, but to a return line 80 into the fuel tank 12. In this embodiment, the drive unit 17 of the high-pressure pump 18 is lubricated in a different way, for example in that the drive unit 17 is connected to a lubricating oil circuit of the internal combustion engine. If the return line 54 or 80 is fed into the fuel tank 12, this achieves a balanced, sustained temperature with only slight temperature differences between the fuel in the tank 12 and the fuel in the circuit.

A return 60 leads from the injectors 26 via a line through which uninjected fuel is diverted. The return 60 from the injectors 26, however, is not conveyed into the fuel tank 12, but feeds into the connection 16 between the fuel-supply pump 10 and the high-pressure pump 18. The return 60 feeds into the connection 16 upstream of the fuel metering device 34 and upstream of the connection 48. The return 60 contains an additional fuel filter 62 and, downstream of this filter, contains a check valve 64 that opens toward the opening of the return 60 into the connection 16. The check valve 64 has a valve element 68 loaded in the closing direction by a spring 66 and consequently opens only if the force exerted on the valve element 68 by the pressure in the return 60 exceeds the force of the closing spring 66. When the pressure in the connection 16 is higher than in the return 60, the check valve 64 prevents fuel delivered by the fuel-supply pump 10 from traveling into the return 60. The check valve 64 can also be used to maintain a preset pressure in the return 60.

It is possible for the reservoir 24 to be provided with a pressure control valve 70 that opens when a preset pressure in the reservoir 24 is exceeded and unblocks an outlet 72 from the reservoir 24, which feeds into the return 60 upstream of the additional fuel filter 62. It is also possible for an outlet 74 to lead from the pressure booster device 32, e.g. for fuel escaping due to a leak in the pressure booster device 32 or for a fuel quantity that is required in order to control the pressure booster device 32, wherein the outlet 74 also feeds into the return 60 upstream of the additional fuel filter 62.

The additional fuel filter 62 in the return 60 is embodied as a fine filter; the fuel flowing through the return 60 contains only a few impurities from the high-pressure pump 18, the reservoir 24, the pressure booster device 32, the injectors 26, or the connections between them. The design and the maintenance interval of the fuel filter 62 can therefore be chosen according to these conditions and independently of the fuel filter 20. The additional fuel filter 62 in the return can in particular also be suitably designed in accordance with the relatively high temperature of the returning fuel. The volume of the additional fuel filter 62 in the return can also damp pressure oscillations and pressure surges that are caused upon termination of the fuel injection in the injectors 26. This prevents a disadvantageous influence from being exerted on the metering device 34 as it adjusts the flow to the high-pressure pump 18. The additional fuel filter 62 can also serve as a fuel cooler or a separate fuel cooler can be provided in the return 60 in order to reduce the temperature of the returned fuel.

The foregoing relates to preferred exemplary embodiments of the invention, it being understood that other variants and embodiments thereof are possible within the spirit and scope of the invention, the latter being defined by the appended claims.

The invention claimed is:

1. A fuel injection device for an internal combustion engine, having a fuel-supply pump (10) that delivers fuel from a fuel tank (12) to a high-pressure pump (18) via a connection (16), wherein the high-pressure pump (18) delivers fuel to a reservoir (24), which is connected to at least one injector (26) that injects fuel into the internal combustion engine, having a fuel filter (20) disposed between the fuel-supply pump (10) and the high-pressure pump (18), wherein a return line (60) for fuel from the at least one injector (26) and/or from the reservoir (24) to a low-pressure region is provided, the improvement comprising an additional fuel filter (62) in the return line (60), downstream of the fuel filter (20), the return line (60) feeding into the connection (16) between the fuel-supply pump (10) and the high-pressure pump (18), wherein the return line (60) contains a check valve (64) that opens toward the opening of the return line (60) into the connection (16).

2. The fuel injection device according to claim 1, further comprising a fuel metering device (34) in the connection (16) of the fuel-supply pump (10) to the high-pressure pump (18), the fuel metering device (34) adjusting the flow of fuel from the fuel-supply pump (10) to the high-pressure pump (18) in such a way that the high-pressure pump (18) generates a preset pressure in the reservoir (24), the return line (60) feeding into the connection (16) upstream of the fuel metering device (34).

3. The fuel injection device according to claim 1, further comprising a pressure booster device (32) between the reservoir (24) and the at least one injector (26) for increasing the pressure prevailing in the reservoir (24), the pressure booster device (32) having an outlet (74) that feeds into the return line (60) upstream of the additional fuel filter (62).

4. The fuel injection device according to claim 2, further comprising a pressure booster device (32) between the reservoir (24) and the at least one injector (26) for increasing the pressure prevailing in the reservoir (24), the pressure booster device (32) having an outlet (74) that feeds into the return line (60) upstream of the additional fuel filter (62).

5. The fuel injection device according to claim 1, further comprising a fuel cooler in the return line (60).

6. The fuel injection device according to claim 2, further comprising a fuel cooler in the return line (60).

7. The fuel injection device according to claim 3, further comprising a fuel cooler in the return line (60).

8. The fuel injection device according to claim 4, further comprising a fuel cooler in the return line (60).

9. A fuel injection device for an internal combustion engine, having a fuel-supply pump (10) that delivers fuel from a fuel tank (12) to a high-pressure pump (18) via a connection (16), wherein the high-pressure pump (18) delivers fuel to a reservoir (24), which is connected to at least one injector (26) that injects fuel into the internal combustion engine, having a fuel filter (20) disposed between the fuel-supply pump (10) and the high-pressure pump (18), wherein a return line (60) for fuel from the at least one injector (26) and/or from the reservoir (24) to a low-pressure region is provided, the improvement comprising an additional fuel filter (62) in the return line (60), downstream of the fuel filter (20), the return line (60) feeding into the connection (16) between the fuel-supply pump (10) and the high-pressure pump (18), further comprising a pressure booster device (32) between the reservoir (24) and the at least one injector (26) for increasing the pressure prevailing in the reservoir (24), the pressure booster device (32) having an outlet (74) that feeds into the return line (60) upstream of the additional fuel filter (62).

10. The fuel injection device according to claim 9, further comprising a fuel cooler in the return line (60).

* * * * *